US008876626B2

(12) United States Patent
Suwa et al.

(10) Patent No.: US 8,876,626 B2
(45) Date of Patent: Nov. 4, 2014

(54) GOLF CLUB

(75) Inventors: Hiroshi Suwa, Yamagata (JP); Daisuke Saito, Yamagata (JP); Naoto Honma, Yamagata (JP); Takeshi Ikeda, Yamagata (JP); Yorihisa Oi, Yamagata (JP)

(73) Assignee: Honma Golf Co., Ltd., Tokyo (JP)

( * ) Notice: Subject to any disclaimer, the term of this patent is extended or adjusted under 35 U.S.C. 154(b) by 247 days.

(21) Appl. No.: 13/503,523

(22) PCT Filed: Oct. 12, 2010

(86) PCT No.: PCT/JP2010/067822
§ 371 (c)(1),
(2), (4) Date: May 21, 2012

(87) PCT Pub. No.: WO2011/048969
PCT Pub. Date: Apr. 28, 2011

(65) Prior Publication Data

US 2012/0225731 A1 Sep. 6, 2012

(30) Foreign Application Priority Data

Oct. 23, 2009 (JP) ..... 2009-244403

(51) Int. Cl.
*A63B 53/02* (2006.01)

(52) U.S. Cl.
USPC ..... 473/307; 473/246; 473/309

(58) Field of Classification Search
USPC ..... 473/288, 307, 309, 244–248
See application file for complete search history.

(56) References Cited

U.S. PATENT DOCUMENTS

| | | | | |
|---|---|---|---|---|
| 8,147,350 | B2 * | 4/2012 | Beach et al. | 473/307 |
| 8,235,834 | B2 * | 8/2012 | De La Cruz et al. | 473/307 |
| 8,622,847 | B2 * | 1/2014 | Beach et al. | 473/307 |
| 2003/0069080 | A1 | 4/2003 | McCabe | |
| 2010/0035701 | A1 | 2/2010 | Kusumoto | |
| 2011/0111881 | A1 * | 5/2011 | Sander et al. | 473/307 |

(Continued)

FOREIGN PATENT DOCUMENTS

| | | |
|---|---|---|
| JP | 2006042950 | 2/2006 |
| JP | 2006042951 | 2/2006 |

(Continued)

*Primary Examiner* — Stephen L. Blau
(74) *Attorney, Agent, or Firm* — Bacon & Thomas, PLLC

(57) ABSTRACT

Disclosed is a golf club having a structure with which optional angle adjustment can be easily and firmly performed by a user himself/herself without changing the direction of a shaft along the circumference thereof with respect to a head. To this end, the distal end portion of the shaft to which a plug member is fixed is fitted into a shaft insertion hole of a hosel portion from above, an angle adjusting member is fitted from below, and a fixing bolt is fitted into a bolt insertion hole of the angle adjusting member and screwed into an internal thread portion of the plug member. A radial clearance is left between the outer circumferential surface of a lower end portion of the plug member fitted into the shaft insertion hole and the inner circumferential surface of the shaft insertion hole corresponding to the outer circumferential surface, and a spacer portion partially formed on the angle adjusting member along the circumference of the angle adjusting member is fitted into a part of the radial clearance along the circumference of the radial clearance. The fixing angle of the head body with respect to the shaft can be adjusted by the circumferential position of the spacer portion fitted into the radial clearance.

13 Claims, 6 Drawing Sheets

(56) References Cited

U.S. PATENT DOCUMENTS

| | | | | |
|---|---|---|---|---|
| 2012/0034996 | A1* | 2/2012 | Murphy et al. | 473/307 |
| 2013/0116062 | A1* | 5/2013 | Zimmerman et al. | 473/307 |
| 2013/0296069 | A1* | 11/2013 | Beach et al. | 473/307 |

FOREIGN PATENT DOCUMENTS

| | | | |
|---|---|---|---|
| JP | 2007222304 | A | 9/2007 |
| JP | 2007229057 | A | 9/2007 |
| JP | 2009050676 | A | 3/2009 |

* cited by examiner

GOLF CLUB

BACKGROUND OF THE INVENTION

1. Field of the Invention

The present invention relates to a golf club which can adjust an angle thereof, that is, can adjust a fixing angle of a head with respect to a center axis of a shaft.

2. Description of the Conventional Art

With respect to a golf club which is put on the market at the present and can adjust an angle thereof, since the angle adjustment is carried out by temporarily taking a shaft out of a head, and further rotating the shaft, in all cases, the shaft is fixed to the head in a state in which it is rotated at a predetermined angle after the angle adjustment in comparison with before the angle adjustment. However, the shaft is structured such that a shaft vibration frequency at a time of hitting a ball is different subtly in correspondence to a fixing direction with respect to the head. Therefore, in accordance with the prior art, since the shaft vibration frequency is changed by carrying out the angle adjustment, a shaft feeling at a time of hitting the ball is changed. A change of the vibration frequency on the basis of a shaft rotating position is described in the following Table 1.

TABLE 1 change of shaft vibration frequency on the basis of angle adjusting position

| vibration | shaft: A | | shaft: B | | shaft: C | |
|---|---|---|---|---|---|---|
| frequency measuring position | vibration frequency | difference | vibration frequency | difference | vibration frequency | difference |
| 0 degree | 210 | ±0 | 231 | ±0 | 278 | ±0 |
| 90 degree | 204 | −6 | 226 | −5 | 271 | −7 |
| 180 degree | 211 | +1 | 230 | −1 | 278 | ±0 |
| 270 degree | 206 | −4 | 227 | −4 | 272 | −6 |
| maximum difference | | 6 | | 5 | | 7 |

note 1) the difference is a numerical value on the basis of the vibration frequency measuring position of 0 degree.

Further, in the prior art, since the shaft is fixed to the head in a state in which it is rotated, after the angle adjustment in comparison with before the angle adjustment as mentioned above, only a grip having a concentric circular shape can be used as a grip, and it is impossible to use a grip which is provided with a directionality on a circumference having a back line. Therefore, it is hard to firmly grasp the grip, and a design of the grip is constrained.

Further, in the prior art, since it is impossible to apply a sufficient chamfering process to an inner diameter portion of an end surface of a part to which the shaft is inserted, a possibility of a shaft breakage becomes large (refer to patent document 1)

Further, there has been proposed a golf club which can easily adjust an angle thereof without changing a direction on a circumference of a shaft, however, the method includes preparing a plurality of angle adjusting parts and re-bonding the selected parts to the shaft, and it can not be necessarily said that the angle adjustment can be easily achieved (refer to patent document 2).

PRIOR ART DOCUMENT

Patent Document

Patent Document 1: Japanese Unexamined Patent Publication No. 2009-050676

Patent Document 2: Japanese Unexamined Patent Publication No. 2006-042951

SUMMARY OF THE INVENTION

Problem to be Solved by the Invention

The present invention is made by taking the point mentioned above into consideration, and an object of the present invention is to provide a golf club having such a structure that a user can adjust an angle to an optional angle easily and firmly without changing a direction on a circumference of a shaft with respect to a head.

Means for Solving the Problem

In order to achieve the object mentioned above, in accordance with a first aspect of the present invention, there is provided a golf club comprising:

a hosel portion which is provided as an integral body or a separate body in a head main body and has a shaft insertion hole formed as a through hole shape;

a closed-end tubular plug member which is fixed to a leading end portion of the shaft and is inserted to the shaft insertion hole;

an angle adjusting member which is inserted to the shaft insertion hole from a lower end opening thereof and is provided with a come-off preventing engagement portion so as to prevent from coming off upward; and a fixing bolt which is inserted from a bolt insertion hole provided in the angle adjusting member and is screwed into a female thread portion provided in an end surface portion of the plug member, thereby detachably fixing the angle adjusting member and a plug member to the hosel portion, wherein a spherical bearing structure is provided in an upper end opening peripheral edge portion of the shaft insertion hole and an outer peripheral portion of the plug member corresponding thereto, a rotation preventing structure for preventing rotation of the plug member with respect to the hosel portion is provided, a diametrical gap is set between an outer peripheral surface of a lower end portion of the plug member which is inserted to the shaft insertion hole and an inner peripheral surface of the shaft insertion hole corresponding thereto, the angle adjusting member is provided with a spacer portion which positions the lower end portion of the plug member in a state of being biased in any direction of a diametrical direction within the shaft insertion hole by being inserted to the diametrical gap in a part on the circumference, and a fixing angle of the head main body with respect to the shaft is adjustable on the basis of what position on the circumference the spacer portion is inserted to the diametrical gap at.

Further, in accordance with a second aspect of the present invention, there is provided a golf club, wherein the spherical bearing structure is constructed by a combination of an annular concave spherical surface portion which is provided in an upper end opening peripheral edge portion of the shaft insertion hole, and an annular convex spherical surface portion which is provided in an annular step portion by setting the step portion in an outer peripheral portion of the plug member, in the configuration described in the first aspect.

Further, in accordance with a third aspect of the present invention, there is provided a golf club, wherein the rotation preventing structure is constructed by a combination of a partial concave portion on the circumference which is provided in an upper end opening peripheral edge portion of the shaft insertion hole, and a partial convex portion on the circumference which is provided in an annular step portion by setting the step portion in an outer peripheral portion of the plug member, in the configuration described in the first aspect.

Further, in accordance with a fourth aspect of the present invention, there is provided a golf club, wherein the shaft insertion hole is formed as a taper surface shape in which an inner diameter is enlarged little by little in a direction from an upper end thereof toward a lower end, and/or the plug member is formed as a taper surface shape in which an outer diameter is reduced little by little in a direction from an upper end thereof toward a lower end, in the configuration described in any one of the first to third aspects, whereby the diametrical gap is set between an outer peripheral surface of a lower end portion of the plug member which is inserted to the shaft insertion hole and an inner peripheral surface of the shaft insertion hole corresponding thereto.

Further, in accordance with a fifth aspect of the present invention, there is provided a golf club, wherein the angle adjusting member has a discoid main body which is inserted to the shaft insertion hole from a lower end opening thereof, an outer peripheral surface of the discoid main body is provided with the come-off preventing engagement portion which is formed as a collar shape or a stepped shape, the spacer portion in a part on the circumference is integrally formed toward one side in an axial direction along an outer peripheral edge portion in one end surface of the discoid main body, the spacer portion is formed as a circular arc shape as seen from one side in the axial direction, and the bolt insertion hole is provided at a center position of a circular shape in which a diameter is set to a length obtained by subtracting a thickness in a diametrical direction of the spacer portion from an outer diameter of the discoid main body, in the configuration described in any one of the first to fourth aspects.

In the golf club in accordance with the present invention having the structure mentioned above, the hosel portion having the shaft insertion hole formed as the through hole shape is provided in the head main body as the integral body or the separate body, and the plug member formed as the closed-end tubular shape is fixed to the leading end portion of the shaft. The plug member is inserted to the shaft insertion hole together with the shaft from the upper end opening thereof, and the angle adjusting member is inserted to the lower end opening of the shaft insertion hole. The angle adjusting member is provided with the come-off preventing engagement portion so as to prevent from coming off upward.

The plug member inserted to the shaft insertion hole is retained to the upper end opening peripheral edge portion of the shaft insertion hole by the spherical bearing structure in the upper end portion of the inserted portion, and the diametrical gap is set between the outer peripheral surface of the lower end portion of the inserted portion and the inner peripheral surface of the shaft insertion hole corresponding thereto. Accordingly, the plug member can oscillate with respect to the hosel portion within the range of the diametrical gap around the spherical bearing structure together with the shaft.

Further, since the angle adjusting member is provided with the spacer portion which is inserted to the diametrical gap in a part on the circumference, it is possible to position the lower end portion of the plug member in a state of being biased to any direction of the diametrical direction within the shaft insertion hole by inserting the spacer portion to the diametrical gap in a part on the circumference, and the fixing angle of the head main body with respect to the shaft can be adjusted on the basis of what position on the circumference the spacer portion is inserted to the diametrical gap at this time.

For example, since the lower end portion of the plug member is biased to the head heel side within the shaft insertion hole in the case that the spacer portion is inserted to the diametrical gap in the head toe side of the plug member, a head lie angle $\alpha$ (FIG. 1) comes to a maximum value. Further, on the contrary, since the lower end portion of the plug member is biased to the head toe side within the shaft insertion hole in the case that the spacer portion is inserted to the diametrical gap in the head heel side of the plug member, the head lie angle $\alpha$ comes to a minimum value.

Further, since the lower end portion of the plug member is biased to the face side within the shaft insertion hole in the case that the spacer portion is inserted to the diametrical gap in the back face side of the plug member, a head face angle $\beta$ (FIG. 6) comes to a maximum value in a slice side. Further, on the contrary, since the lower end portion of the plug member is biased to the back face side within the shaft insertion hole in the case that the space portion is inserted to the diametrical gap in the face side of the plug member, the head face angle $\beta$ comes to a maximum value in a hook side.

Further, since the spacer portion can be inserted to anyplace in an endless range at 360 degree on a circumference, an angle adjustment at two angle adjusting positions is complexly carried out in the case that it is inserted to the diametrical gap at an intermediate position (a diagonal position) of the two angle adjusting positions among the above four angle adjusting positions.

Next, if a preferable angle adjusting position is decided, a fixing bolt is inserted form a bolt insertion hole which is provided in the angle adjusting member, and is screwed into a female thread portion which is provided in the end surface portion of the plug member, whereby the angle adjusting member and the plug member are fixed to the hosel portion, and the shaft is fixed to the hosel portion since the plug member is previously fixed to the shaft. Since the fixation by the fixing bolt is detachable by fastening or loosening the fixing bolt, it is possible to readjust time and time again.

In this case, in the structure mentioned above, since the rotation preventing structure is provided in the upper end opening peripheral edge portion of the shaft insertion hole which is provided in the hosel portion and the outer peripheral portion of the plug member which corresponds thereto, the plug member and the shaft fixing it do not rotate but oscillate at the time of angle adjustment, and a direction on the circumference of the shaft with respect to the head does not change at all. Accordingly, the shaft vibration frequency does not change even after the angle adjustment, and it is possible to use the grip which has the back line and is provided with the directionality on the circumference.

As a specific example of the spherical bearing structure, there can be listed up a combination of an annular concave spherical portion which is provided in the upper end opening peripheral edge portion of the shaft insertion hole, and an annular convex spherical portion which is provided in an annular step portion by setting the step portion in an outer peripheral portion of the plug member. In accordance with this combined structure, a concentricity between the upper end opening peripheral edge portion of the shaft insertion hole and the annular step portion in the outer periphery of the plug member can be always secured, and the plug member and the shaft can smoothly oscillate with respect to the hosel portion (the second aspect).

As a specific example of the rotation preventing structure mentioned above, there can be listed up a combination of a partial concave portion on the circumference which is provided in an upper end opening peripheral edge portion of the shaft insertion hole, and a partial convex portion on the circumference which is provided in an annular step portion by setting the step portion in an outer peripheral portion of the plug member. In accordance with this combined structure, the hosel portion, the plug member and the shaft can be securely prevented from rotating (the third aspect).

Further, in the structure mentioned above, among the inserted portion of the plug member which is inserted to the shaft insertion hole, the diametrical gap with respect to the inner peripheral surface of the insertion hole is hardly set in the upper end portion thereof, and the diametrical gap with respect to the inner peripheral surface of the insertion hole is set only in the lower end portion thereof. However, this can be achieved by the shaft insertion hole being formed as a taper surface shape in which an inner diameter is enlarged little by little in a direction from an upper end thereof toward a lower end, and/or the plug member being formed as a taper surface shape in which an outer diameter is reduced little by little in a direction from an upper end thereof toward a lower end, and it is possible to adjust a magnitude of the angle adjusting range in accordance with how much angle the taper angles are set at a time of manufacturing (the fourth aspect).

As a specific example of the angle adjusting member, there can be listed up such a structure that it has a discoid main body which is inserted to the shaft insertion hole from a lower end opening thereof, an outer peripheral surface of the discoid main body is provided with the come-off preventing engagement portion which is formed as a collar shape or a stepped shape, the spacer portion in a part on the circumference is integrally formed toward one side in an axial direction along an outer peripheral edge portion in one end surface of the discoid main body, and the spacer portion is formed as a circular arc shape as seen from one side in the axial direction. In accordance with this shape or structure, since the spacer portion is integrated in the discoid main body, the spacer portion rotates by rotating the discoid main body, whereby an angle adjusting work can be made easy (the fifth aspect).

In this case, if the spacer portion is provided in a part on the circumference along the outer peripheral edge portion in the one end surface of the discoid main body, and is inserted to a part on the circumference of the diametrical gap between the outer peripheral surface of the plug member and the inner peripheral surface of the shaft insertion hole, the discoid main body and the end surface portion of the plug member are biased from each other. Accordingly, in the case that the bolt insertion hole and the female thread portion are provided at respective center positions of the both, there is a risk that they are biased from each other and the fixing bolt can not be screwed thereto. Then, in accordance with the present invention, the bolt insertion hole is provided at a center position of a circular shape in which a diameter is set to a length obtained by subtracting a thickness in a diametrical direction of the spacer portion from an outer diameter of the discoid main body, whereby the bolt insertion hole and the female thread portion are aligned their positions with each other all the time regardless of the angle adjusting position and the fixing bolt can be screwed thereto. The circular shape means a circle which internally touches with the inner surface of the circular arc shaped spacer and internally touches with the outer peripheral surface of the discoid main body at a 180 degree symmetrical position, and this circle itself is set at a position which is biased from the discoid main body (the fifth aspect).

Effect of the Invention

In accordance with the present invention having the structure mentioned above, it is possible to provide the golf club having such a structure that a user can adjust the angle to an optional angle easily and firmly without changing the direction on the circumference of the shaft with respect to the head. The direction on the circumference of the shaft with respect to the head does not change, whereby the shaft vibration frequency does not change after the angle adjustment, and it is possible to use the grip which has the back line and is provided with the directionality on the circumference. Since the angle adjustment is carried out by loosening the fixing bolt and rotating the angle adjusting member, it is not necessary to detach the shaft. Since the fixation is carried out by fastening the fixing bolt, it is extremely firm and it is possible to easily readjust. Further, since the angle adjustment is an endless stepless adjustment at 360 degree on the circumference, the user can carry out a fine adjustment in correspondence to a preference.

In accordance with the structure of the second aspect, the concentricity between the upper end opening peripheral edge portion of the shaft insertion hole and the annular step portion in the outer periphery of the plug member can be always secured, and the plug member and the shaft smoothly oscillate with respect to the hosel portion. In accordance with the structure of the third aspect, the hosel portion, the plug member and the shaft can be securely prevented from rotating. In accordance with the structure of the fourth aspect, it is possible to adjust the magnitude of the angle adjusting range in accordance with how much angle the tapers are set at a time of manufacturing. In accordance with the structure of the fifth aspect, since the spacer portion rotates by rotating the discoid main body, the angle adjusting work is made easy, and the screwing work by the fixing bolt is smoothened.

BRIEF DESCRIPTION OF THE DRAWINGS

FIGS. 6A and 6B are explanatory views of a state in which the angle adjusting member is rotated rightward at 90 degree, in which FIG. 6A is a plan view of a head, and FIG. 6B is a schematic horizontal cross sectional view which shows an arrangement of a spacer portion at this time;

FIGS. 7A and 7B are explanatory views of a state in which the angle adjusting member is rotated leftward at 90 degree, in which FIG. 7A is a plan view of the head, and FIG. 7B is a schematic horizontal cross sectional view which shows an arrangement of the spacer portion at this time.

DESCRIPTION OF REFERENCE NUMERALS

Figure 1:
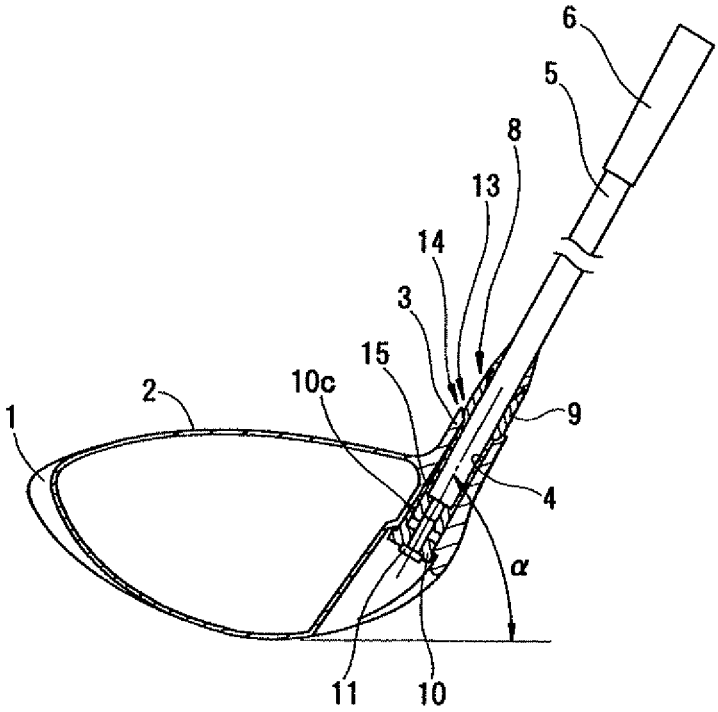
FIG. 1 is a vertical cross sectional view of a golf club in accordance with an embodiment of the present invention.

1 head
2 head main body
2*a* face
3 hosel portion
3*f* concave spherical portion
3*g* concave portion
4 shaft insertion hole
5 shaft
6 grip
8 hosel joint system structure
9 plug member
9*a* step portion
9*b* inserted portion
9*c* hosel extension portion
9*d* end surface portion
9*e* female thread portion
9*f* convex spherical portion
9*g* convex portion
10 angle adjusting member
10*a* discoid main body
10*b* come-off preventing engagement portion
10*c* spacer portion
10*d* bolt insertion hole
10*e* circular shape
11 fixing bolt
13 spherical bearing structure
14 rotation preventing structure
15 diametrical gap

MODE FOR CARRYING OUT THE INVENTION

The following embodiments are included in the present invention.

(1) In order to achiever the object mentioned above, the present invention includes a golf club head which is open in a hosel upper end positioned in a heel side of a head main body and has a part insertion hole penetrating to a sole side, a hosel part portion which is inserted to the insertion hole, and is applied a spherical shaped chamfer in an inner diameter side of an upper end portion while having a taper hole, and in which a head rotation preventing concave shape is arranged, a plug portion which is inserted thereto together with a shaft, is bonded to a leading end portion of the shaft, is provided with a thread hole in a bottom surface, is worked as a spherical surface in a portion meeting with the spherical shaped chamfer portion in the upper end of the hosel part portion, has a head rotation preventing convex portion, and is applied a taper work for preventing a shaft breakage in an inner diameter portion of an upper end thereof, an angle adjusting unit which is inserted with respect to the plug portion inserted to the hosel part having a taper hole, is open while shifting a center at an optional angle (from 1 degree to 3 degree, preferably from 1 degree to 2 degree) from a center of the bottom surface, and has a through hole for passing a fixing bolt therethrough, and a bolt which is connected by screw to the plug portion installed to a shaft leading end portion provided with the thread hole.

(2) In accordance with this, the user can select an optional angle adjusting position by rotating the angle adjusting unit portion without pulling out or inserting and rotating the shaft to which the grip is installed.

(3) Further, with regard to the hosel part portion, since it is possible to directly employ the function of the part in the hosel hole portion of the head main body, that is, integrally mold the structure of, the part at a time of molding the head, it is possible to lighten a weight of the hosel part portion, and it is possible to achieve a low gravity point of the head. In this case, the golf club is not limited to wood clubs (a number one wood, a fairway wood, a utility wood) and the like, but includes iron clubs and a putter to which the angle adjusting parts can be applied.

(4) In the contact surface of the plug portion to which the hosel part portion and the shaft are installed, that is, the meeting surface, there is included such a structure that it is firmly fixed by having a spherical shaped meeting surface which is provided with no gap and no step and is excellent in adhesion, having a unique shape with respect to a concavo-convex shape for preventing the head rotation, and carrying out a fixing at a fixed torque by a connecting bolt.

In accordance with the structures (1) to (4) mentioned above, the following operations and effects can be achieved.

(5) By the angle adjusting parts in accordance with the present invention, it is possible to adjust an angle while keeping the vibration frequency of the shaft constant.

(6) Since the shaft can be kept in a fixed direction, it is possible to freely select a shaft design.

(7) Since the shaft can be kept in a fixed direction, it is possible to install a grip having a functionality such as a freedom of selecting the design of the grip, the back line or the like.

(8) Since it is structured such that the head and the shaft can be easily attached and detached, it is possible to freely select the kind of the shaft.

(9) With regard to the angle adjusting position, the user can freely select an optional angle adjusting position regardless of the angle adjusting position which is designated by the manufacturer side.

(10) Since a chamfering work can be applied to the shaft bonding portion of the plug, it is possible to widely reduce the shaft breakage.

(11) With regard to the hosel part portion among these angle adjusting parts, since it is possible to directly mold the structure thereof as an integral structure in the head main body, a weight of the hosel part portion can be saved, and the saved weight can be distributed into the head main body. Therefore, it is possible to make the gravity center of the head further low.

EMBODIMENT

Figure 2:
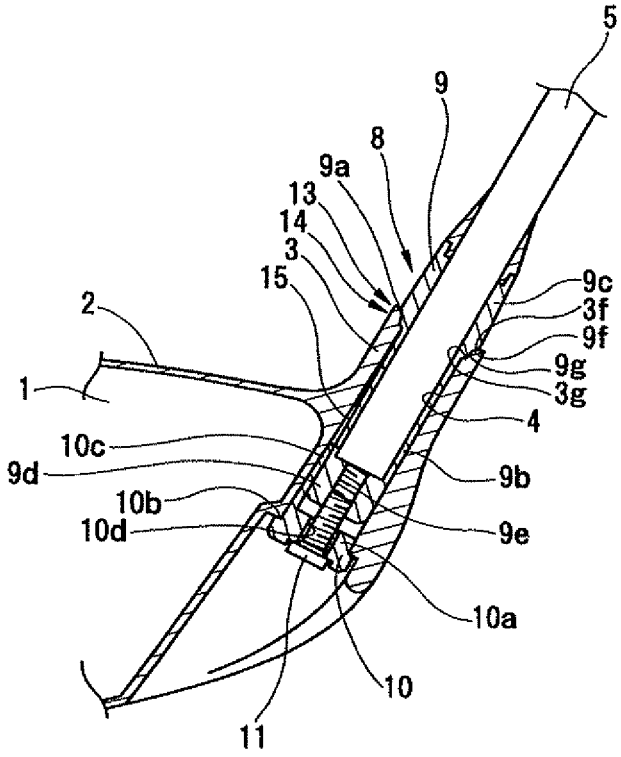
FIG. 2 is an enlarged view of a substantial part in FIG. 1.
Figure 3:
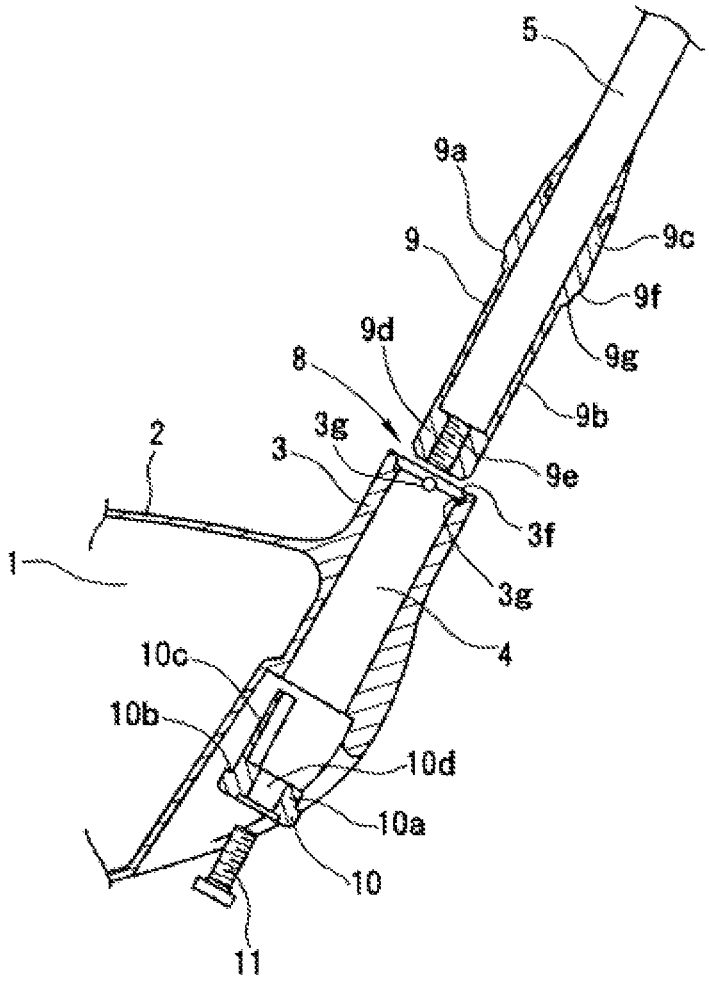
FIG. 3 is a vertical cross sectional view of a substantial part in a state in which the golf club is exploded.

Next, a description will be given of an embodiment in accordance with the present invention with reference to the accompanying drawings. FIG. 1 is a vertical cross sectional view of a golf club in accordance with an embodiment of the present invention, and an enlarged view of a substantial part thereof is shown in FIG. 2. Further, FIG. 3 is a vertical cross sectional view in a state in which the golf club is exploded.

The golf club in accordance with the embodiment has a hosel joint system structure 8 as well as having a golf club head (which may be simply called as a head) 1, a shaft 5 and a grip 6, and this hosel joint system structure 8 has a hosel portion 3 which is integrally provided in a head main body 2 in the head 1 and has a through hole shaped shaft insertion hole 4, a closed-end tubular plug member (which may be called as a plug portion) 9 which is fixed to a leading end portion of the shaft 5 and is inserted to a shaft insertion hole 4, an angle adjusting member (which may be called as an angle adjusting unit 10) which is inserted to the shaft insertion hole 4 from a lower end opening thereof and is provided with a come-off preventing engagement portion 10*b* for preventing from coming off upward, and a fixing bolt 11 which is inserted from a bolt insertion hole 10*d* provided in the angle adjusting member 10, and detachably fixes the angle adjusting member 10 and the plug member 9 with respect to the hosel portion 3 by being screwed into a female thread portion 9*c* provided in an end surface portion 9*d* of the plug member 9.

The head 1 is constructed by a hollow body which is obtained, for example, by precision casting of a titanium alloy, has the head main body 2 which is provided with a face, a crown, a sole, a heel and a back face, and further integrally has the hosel portion 3 mentioned above.

The shaft insertion hole 4 provided in the hosel portion 3 is formed as the through hole shape as mentioned above, and is formed as a taper surface shape in which an inner diameter is enlarged little by little in a direction from an upper end toward a lower end in an inner peripheral surface thereof. In this case, although not being illustrated, a separate sleeve (which may be called as a hosel part portion) may be firmly attached to an inner peripheral surface of the through hole provided in the hosel portion 3 and an inner peripheral space thereof may be utilized as the shaft insertion hole 4 formed as the through hole shape in the same manner. In this case, the inner peripheral surface of the sleeve is formed as the taper surface shape. Further, in this case, it is preferable that the sleeve is obtained by machining a cast material or a forged material, for example, of a titanium alloy or an aluminum alloy.

The plug member 9 which is fixed to the leading end of the shaft 5 is formed as the closed-end tubular shape as mentioned above, and is inserted and fixed to the leading end of the shaft 5, for example, by means of an adhesive bonding or the like. Further, the plug member 9 is constructed, for example, by machining the cast material or the forged material of the titanium alloy or the aluminum alloy, has an annular step portion 9*a* in an outer peripheral surface of a cylinder portion, is provided with an inserted portion 9*b* which is inserted to the shaft insertion hole 4 and has a comparatively smaller diameter, in a lower side on the boundary of the step portion 9*a*, and is provided with a hosel extension portion 9*c* which is arranged above the hosel portion 3 without being inserted to the shaft insertion hole 4 and has a comparatively larger diameter, in an upper side thereof.

The step portion 9*a* is structured such as to be brought into contact with an upper end opening peripheral edge portion of the shaft insertion hole 4, that is, an upper end portion of the hosel portion 3 so as to be retained, is provided with a spherical bearing structure 13 therein, and is provided with a rotation preventing structure 14 for preventing the plug member 9 from rotating with respect to the hosel portion 3. The spherical bearing structure 13 is constructed by a combination of an annular concave spherical portion 3*f* which is provided in the upper end opening peripheral edge portion of the shaft insertion hole 4, and an annular convex spherical portion 9*f* which is provided in the step portion 9*a*, and a bearing function is achieved by a sliding motion of both the spherical portions 3*f* and 9*f*. On the other hand, the rotation preventing structure 14 is constructed by a combination of a circumferentially partial concave portion 3*g* which is provided in the upper end opening peripheral edge portion of the shaft insertion hole 4, and a circumferentially partial convex portion 9*g* which is provided in the step portion 9*a*, and a rotation preventing function is achieved on the basis of an engagement in a circumferential direction of the concave portion 3*g* and the convex portion 9*g*. It is preferable that a combination of the concave portion 3*g* and the convex portion 9*g* are provided at a plurality of positions (for example, four uniform positions) on the circumference, however, however may they are provided, they are formed such a shape that does not obstruct the bearing function by both the spherical portions 3*f* and 9*f* (for example, such a circular arc cross sectional shape that the concave portion 3*g* and the convex portion 9*g* can slide in the same direction with each other in accordance with the sliding motion of both the spherical portions 31 and 9*f*). In this case, since the concave spherical portion 31 is previously provided in the upper end opening peripheral edge portion of the shaft insertion hole 4, the concave portion 3*g* is provided on the surface of the concave spherical portion 3*f*, or is provided at a position from the concave spherical portion 3*f* toward the inner peripheral surface of the shaft insertion hole 4 as illustrated. Further, in the same manner, since the convex spherical portion 9*f* is previously provided in the step portion 9*a*, the convex portion 9*g* is provided on the surface of the convex spherical portion 91, or is provided at a position from the convex spherical portion 91 toward the outer peripheral surface of the hosel extension portion 9*c* as illustrated.

The inserted portion 9*b* in the plug member 9 is formed as an axially straight cylindrical shape in its outer peripheral surface, and an outer diameter thereof is set to be approximately the same as an inner diameter of the upper end portion of the shaft insertion hole 4 (that is, a minimum inner diameter of the shaft insertion hole 4). On the other hand, as mentioned above, the shaft insertion hole 4 is formed as a taper surface shape in which an inner diameter of an inner peripheral surface is expanded little by little from an upper end thereof toward a lower end. Accordingly, a gap is hardly generated in an outer periphery of an upper end portion of the inserted portion 9*b*, however, a diametrical gap 15 is formed in an outer periphery of a lower end portion of the inserted portion 9*b* with respect to an inner peripheral surface of the shaft insertion hole 4. Therefore, the plug member 9 can oscillate with respect to the hosel portion 3 within a range of this diametrical gap 15, by setting the spherical bearing structure 13 as a center of oscillation.

Further, since the plug member 9 is formed as a closed-end tubular shape as mentioned above, it has an end surface portion 9*d* in a lower end thereof, and is provided with a female thread portion (a female thread hole) 9*e* at a center position of the end surface portion 9*d*.

The angle adjusting member 10 is obtained by machining, for example, the titanium alloy or the aluminum alloy material, has a discoid main body 10*a* which is inserted to the shaft insertion hole 4 from a lower end opening thereof, and is provided with an annular come-off preventing engagement portion 10*b* which is formed as a collar shape or a step shape, in an outer peripheral surface of the discoid main body 10*a*. The come-off preventing engagement portion 10*b* is engaged with a lower end opening peripheral edge portion of the shaft insertion hole 4 in an axial direction, and prevents the angle adjusting member 10 from coming off upward.

Figure 4:
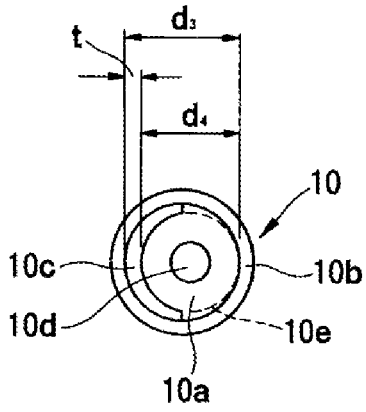
FIG. 4 is a plan view of an angle adjusting member.

Further, a circumferentially partial spacer portion 10*c* is integrally formed in an upper end surface, of the discoid main body 10*a* so as to be directed upward along an outer peripheral edge portion thereof. FIG. 4 shows a plan view of the angle adjusting member 10. As shown in this FIG. 4, the spacer portion 10*c* is formed as a circular arc shape or an approximately circular arc shape as seen from one side in an axial direction so as to form a circumferentially partial shape of the cylinder, and is inserted to the diametrical gap 15 in a part on the circumference, thereby achieving such a function as to position the lower end portion of the plug member 9 in a state of being biased to any direction in a diametrical direction within the shaft insertion hole 4. Therefore, a thickness t in a diametrical direction of the spacer portion 10*c* is principally obtained by an expression $t \approx d1 - d2$, in which an inner diameter in the vicinity of the lower end portion of the shaft insertion hole 4 is set to d1, and an outer diameter of the inserted portion 9*b* of the plug member 9 is set to d2.

In this case, since the inner peripheral surface of the shaft insertion hole 4 is formed as the taper shape in which the inner diameter is expanded little by little toward the lower end as mentioned above, it is further preferable that the thickness of the spacer portion 10*c* is made thinner little by little toward the leading end in correspondence thereto. Further, it is further preferable to form the outer peripheral surface of the spacer portion 10*c* which comes into contact with the inner peripheral surface of the shaft insertion hole 4 as the taper shape in correspondence to the inner peripheral surface, and form the inner peripheral surface of the spacer portion 10*c* which comes into contact with the outer peripheral surface of the inserted portion 9*b* of the plug member 9 as the axially straight cylindrical shape in correspondence to the outer peripheral surface. Further, when the lower end of the inserted portion 9*b* of the plug member 9 is biased to one direction in a diametrical direction within the shaft insertion hole 4, the diametrical gap 15 is doubled in its diametrically maximum width and an axially vertical cross sectional shape is formed in such a crescent shape as to becomes narrower in width little by little respectively toward both ends in a circumferential direction. Therefore, it is further preferable to make a thickness of the spacer portion 10*c* thinner little by little respectively toward both ends in the circumferential direction as shown in FIG. 4 in correspondence to the crescent shape. They are all effective for making a gap after assembling as small as possible, thereby holding down a play so as to connect firmly the plug member 9 to the hosel portion 3. Further, in FIG. 4, a circumferentially set angle (an angle of a circular arc) of the spacer portion 10*c* is set to approximately 180 degree, and the larger angle stables the connection, however, it may be sufficient functionally even if it is smaller than 180 degree.

Further, the discoid main body 10*a* is provided with a bolt insertion hole 10*d* for inserting a male thread portion of the fixing bolt 11. An inner diameter of the bolt insertion hole 10*d* is set to be smaller than an outer diameter of a head portion of the fixing bolt 11. Further, the bolt insertion hole 10*d* is provided at a center position of a circular shape 10*e* in which a length d4 obtained by subtracting a diametrically thickness t of the spacer portion 10*c* from an outer diameter d3 of the discoid main body 10*a* is set to a diameter, as shown in FIG. 4. The circular shape 10*e* means such a circle that touches internally with an inner peripheral surface of the circular arc shaped spacer portion 10*c* and touches internally with an outer peripheral surface of the discoid main body 10*a* at a 180 degree symmetrical position, as shown by a dotted line on the drawing. In other words, the end surface portion 9*d* of the plug member 9 is supposed as the circular shape 10*e*.

The golf club having the structure mentioned above is structured such that the leading end portion of the shaft 5 fixing the plug member is inserted to the shaft insertion hole 4 of the hosel portion 3 from the above, the angle adjusting member 10 is inserted to the shaft insertion hole 4 from the below, and the fixing bolt 11 is inserted from the bolt insertion hole 10*d* of the angle adjusting member 10 so as to be screwed into the female thread portion 9*e* of the plug member 9, at a time of assembling. The fixing angle of the head 1 with respect to the center axis of the shaft 5 is adjusted as mentioned below.

(1) In other words, the shaft 5 to which the grip 6 fixing the plug member 9 has been installed is inserted from the above to the shaft insertion hole 4 of the hosel portion 3 by setting a position at which a shaft performance is achieved to the maximum to a front surface. Next, the angle adjusting member 10 is inserted to the shaft insertion hole 4 from the below, and is installed in such a manner that the circumferentially partial spacer portion 10*c* is positioned in the head toe side, for example, as shown in FIG. 1 and FIG. 2. Next, the fixing bolt 11 is screwed into the female thread portion 9*e* of the plug member 9 by being inserted from the bolt insertion hole 10*d* of the angle adjusting member 10, and fastens the plug member 9 and the angle adjusting member 10 at a designated torque. In the case of adjusting the angle in accordance with the procedure mentioned above, the lie angle α comes to an upright maximum value.

Figure 5:
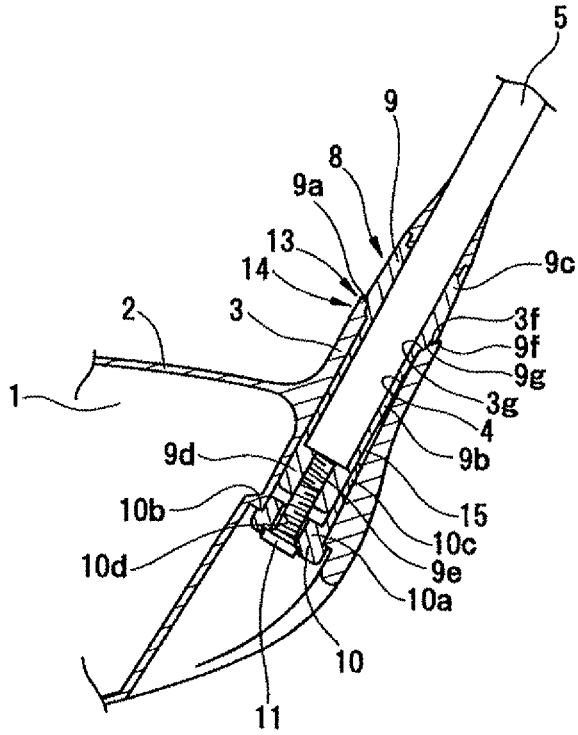
FIG. 5 is a vertical cross sectional view of a substantial part of a state in which the angle adjusting member is rotated at 180 degree.

(2) Next, a method of adjusting the lie angle α mentioned above flat is shown. First of all, the fixing bolt 11 is loosened at such a degree that the shaft 5 does not rotate, the angle adjusting member 10 is rotated at 180 degree to the heel side as shown in FIG. 5, and the fixing bolt 11 is again fastened at the designated torque. In the case of adjusting the angle in accordance with the method mentioned above, the lie angle α comes to a minimum value (flat).

Figure 6A:
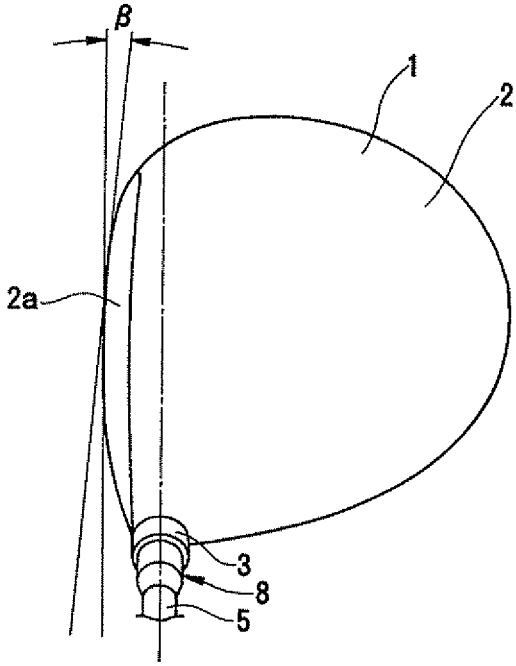
Figure 6B:
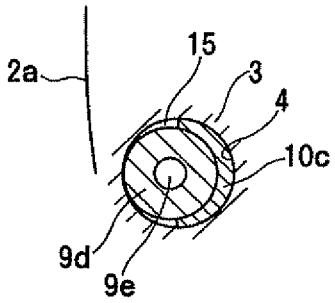

(3) Next, a method of adjusting the face angle β to the slice side is shown. First of all, the fixing bolt 11 is loosened at such a degree that the shaft 5 does not rotate, the angle adjusting member 10 is rotated rightward at 90 degree from the position in FIG. 1 and FIG. 2 as shown in FIG. 6, and the fixing bolt 11 is fastened again at a designated torque. In the case of adjusting the angle in accordance with the method mentioned above, the face angle β comes to a slice side maximum value.

Figure 7A:
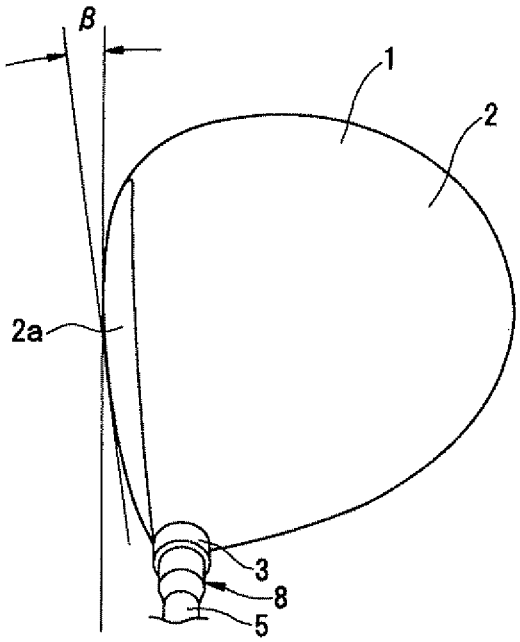
Figure 7B:
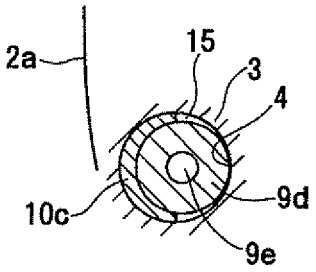

(4) Next, a method of adjusting the face angle β to the hook side is shown. First of all, the fixing bolt 11 is loosened at such a degree that the shaft 5 does not rotate, the angle adjusting member 10 is rotated leftward at 90 degree from the position in FIG. 1 and FIG. 2 as shown in FIG. 7, and the fixing bolt 11 is fastened again at a designated torque. In the case of adjusting the angle in accordance with the method mentioned above, the face angle β comes to a hook side maximum value.

A relationship of a lie angle, a loft angle and a face angle in the case of adjusting angle in accordance with the angle adjusting method mentioned above is shown in Table 2.

TABLE 2 example of angle adjustment by angle adjusting unit

| No. | angle of rotation of angle adjusting unit | lie angle | loft angle | face angle |
|---|---|---|---|---|
| 1 | 0 degree | 61.0° | 20.2° | 0° |
| 2 | 90 degree | 59.7° | 20.9° | +1.6° |
| 3 | 180 degree | 59.0° | 20.2° | 0° |
| 4 | 270 degree | 60.0° | 20.5° | −1.8° |
| | angle adjusting range | 2.0° | 0.7° | 3.4° |

note 1) An example in the case of rotating in a clockwise direction in the case of viewing the angle adjusting member 10 from an upper crown side, by setting a lie angle maximum value as a reference (0 degree).

note 2) An example in which a taper angle of an inner diameter portion of the shaft insertion hole 4 is 1.0 degree.

note 3) The face angle β is an angle formed by the face surface 2*a* with respect to a direction which is orthogonal to the shaft center axis. The slice face is displayed as positive, and the hook face is displayed as negative.

note 4) The head 1 used in this example of the angle adjustment shows an example of a wood type utility head (a loft angle of 20 degree).

This Table 2 exemplifies four positions which are the representative angle adjusting positions, however, since the angle adjusting member can rotate at 360 degree from the position at 0 degree, and can adjust the angle continuously, the user can adjust the angle at an optional position.

Further, in this angle adjustment corresponding golf club, since the shaft 5 can be attached and detached easily by completely loosening the fixing bolt 11, it is possible to select a different kind of the shaft 5.

The golf club in accordance with the present invention is not limited to the wood club (the number one wood, the fairway wood, the utility wood), but can include the iron clubs and the putter.

Figure 8:
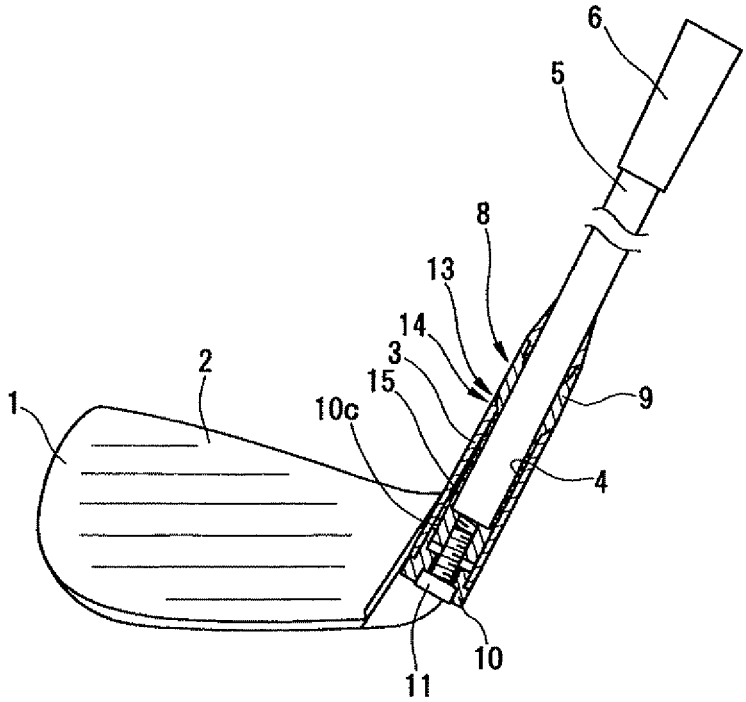
FIG. 8 is a vertical cross sectional view of a golf club in accordance with another embodiment of the present invention.

The description is given above of the preferable embodiment in accordance with the present invention, however, the present invention can be appropriately modified its structure within the scope as long as it does not deflect from the aimed range, in addition to the described embodiment mentioned above. For example, as shown in FIG. 8, the hosel portion 3 may be formed independently without being structured integrally with the head main body 2.

What is claimed is:

1. A golf club comprising:

a hosel portion which is provided as an integral body or a separate body in a head main body and has a shaft insertion hole formed as a through hole shape;

a closed-end tubular plug member which is fixed to a leading end portion of a shaft and is inserted to said shaft insertion hole;

an angle adjusting member which is inserted to said shaft insertion hole from a lower end opening thereof and is provided with a come-off preventing engagement portion so as to prevent from coming off upward; and a fixing bolt which is inserted from a bolt insertion hole provided in said angle adjusting member and is screwed into a female thread portion provided in an end surface portion of said plug member, thereby detachably fixing said angle adjusting member and a plug member to said hosel portion, wherein a spherical bearing structure is provided in an upper end opening peripheral edge portion of said shaft insertion hole and an outer peripheral portion of said plug member corresponding thereto, and a rotation preventing structure for preventing rotation of said plug member with respect to said hosel portion is provided, wherein a diametrical gap is set between an outer peripheral surface of a lower end portion of said plug member which is inserted to said shaft insertion hole and an inner peripheral surface of said shaft insertion hole corresponding thereto, wherein said angle adjusting member is provided with a spacer portion which positions the lower end portion of said plug member in a state of being biased in any direction of a diametrical direction within said shaft insertion hole by being inserted to said diametrical gap in a part on the circumference, and wherein a fixing angle of said head main body with respect to said shaft is adjustable on the basis of what position on the circumference said spacer portion is inserted to said diametrical gap at.

2. A golf club as claimed in claim 1, wherein said spherical bearing structure is constructed by a combination of an annular concave spherical surface portion which is provided in an upper end opening peripheral edge portion of said shaft insertion hole, and an annular convex spherical surface portion which is provided in an outer step portion by setting the step portion in an outer peripheral portion of said plug member.

3. A golf club as claimed in claim 2, wherein said shaft insertion hole is formed as a taper surface shape in which an inner diameter is enlarged little by little in a direction from an upper end thereof toward a lower end, and/or said plug member is formed as a taper surface shape in which an outer diameter is reduced little by little in a direction from an upper end thereof toward a lower end, whereby the diametrical gap is set between an outer peripheral surface of a lower end portion of said plug member which is inserted to said shaft insertion hole and an inner peripheral surface of said shaft insertion hole corresponding thereto.

4. A golf club as claimed in claim 3, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

5. A golf club as claimed in claim 2, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

6. A golf club as claimed in claim 1, wherein said rotation preventing structure is constructed by a combination of a partial concave portion on the circumference which is provided in the upper end opening peripheral edge portion of said shaft insertion hole, and a partial convex portion on the circumference which is provided in an annular step portion by setting the step portion in an outer peripheral portion of said plug member.

7. A golf club as claimed in claim 6, wherein said shaft insertion hole is formed as a taper surface shape in which an inner diameter is enlarged little by little in a direction from an upper end thereof toward a lower end, and/or said plug member is formed as a taper surface shape in which an outer diameter is reduced little by little in a direction from an upper end thereof toward a lower end, whereby the diametrical gap is set between an outer peripheral surface of a lower end portion of said plug member which is inserted to said shaft insertion hole and an inner peripheral surface of said shaft insertion hole corresponding thereto.

8. A golf club as claimed in claim 7, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

9. A golf club as claimed in claim 6, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

10. A golf club as claimed in claim 1, wherein said shaft insertion hole is formed as a taper surface shape in which an inner diameter is enlarged little by little in a direction from an upper end thereof toward a lower end, and/or said plug member is formed as a taper surface shape in which an outer diameter is reduced little by little in a direction from an upper end thereof toward a lower end, whereby the diametrical gap is set between an outer peripheral surface of a lower end portion of said plug member which is inserted to said shaft insertion hole and an inner peripheral surface of said shaft insertion hole corresponding thereto.

11. A golf club as claimed in claim 10, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

12. A golf club as claimed in claim 1, wherein said angle adjusting member has a discoid main body which is inserted to said shaft insertion hole from a lower end opening thereof, an outer peripheral surface of said discoid main body is provided with said come-off preventing engagement portion which is formed as a collar shape or a stepped shape, said spacer portion in a part on the circumference is integrally formed toward one side in an axial direction along an outer peripheral edge portion in one end surface of said discoid main body, and said spacer portion is formed as a circular arc shape as seen from one side in the axial direction, and wherein said bolt insertion hole is provided at a center position of a circular shape in which a diameter is set to a length obtained by subtracting a thickness in a diametrical direction of said spacer portion from an outer diameter of said discoid main body.

13. A golf club comprising:

a hosel portion which is provided as an integral body or a separate body in a head main body and has a shaft insertion hole formed as a through hole shape;

a closed-end tubular plug member which is fixed to a leading end portion of a shaft and is inserted to said shaft insertion hole;

an angle adjusting member which is inserted to said shaft insertion hole from a lower end opening thereof and is provided with a come-off preventing engagement portion so as to prevent from coming off upward; and a fixing bolt which is inserted from a bolt insertion hole provided in said angle adjusting member and is screwed into a female thread portion provided in an end surface portion of said plug member, thereby detachably fixing said angle adjusting member and a plug member to said hosel portion, wherein a spherical bearing structure is provided in an upper end opening peripheral edge portion of said shaft insertion hole and an outer peripheral portion of said plug member corresponding thereto, wherein a diametrical gap is set between an outer peripheral surface of a lower end portion of said plug member which is inserted to said shaft insertion hole and an inner peripheral surface of said shaft insertion hole corresponding thereto, wherein said angle adjusting member is provided with a spacer portion which positions the lower end portion of said plug member in a state of being biased in any direction of a diametrical direction within said shaft insertion hole by being inserted to said diametrical gap in a part on the circumference, and wherein a fixing angle of said head main body with respect to said shaft is adjustable on the basis of what position on the circumference said spacer portion is inserted to said diametrical gap at.

* * * * *